US006990764B2

(12) United States Patent
Walker

(10) Patent No.: US 6,990,764 B2
(45) Date of Patent: Jan. 31, 2006

(54) SHOTGUN ATTACHMENT

(75) Inventor: Ronald N. Walker, Cobb, WI (US)

(73) Assignee: Inpromarketing Corp., Cobb, WI (US)

( * ) Notice: Subject to any disclaimer, the term of this patent is extended or adjusted under 35 U.S.C. 154(b) by 4 days.

(21) Appl. No.: 10/365,290

(22) Filed: Feb. 12, 2003

(65) Prior Publication Data

US 2004/0154209 A1 Aug. 12, 2004

(51) Int. Cl.
*F41A 21/00* (2006.01)

(52) U.S. Cl. ..... 42/79; 42/76.01; 89/14.05

(58) Field of Classification Search ..... 42/79, 42/76.01; 89/14.05
See application file for complete search history.

(56) References Cited

U.S. PATENT DOCUMENTS

| | | | | |
|---|---|---|---|---|
| 2,092,649 A | | 9/1937 | Jung | |
| 2,968,111 A | * | 1/1961 | Steane | 42/79 |
| 3,029,540 A | * | 4/1962 | Pachmayr | 42/79 |
| 3,045,379 A | | 7/1962 | Cutts | |
| 3,166,865 A | * | 1/1965 | Grahn | 42/79 |
| 3,284,942 A | * | 11/1966 | Mosely | 42/79 |
| 3,440,924 A | * | 4/1969 | Sawyer | 89/14.5 |
| 3,797,155 A | * | 3/1974 | Smith et al. | 42/79 |
| 5,157,211 A | * | 10/1992 | Mossberg | 42/79 |
| 5,317,825 A | | 6/1994 | Vatterott et al. | |
| 5,452,535 A | * | 9/1995 | See et al. | 42/79 |
| 6,052,935 A | * | 4/2000 | Howard | 42/79 |
| 6,128,846 A | * | 10/2000 | Walker et al. | 42/79 |
| 6,385,891 B1 | * | 5/2002 | Rabatin | 42/79 |
| 6,421,945 B1 | * | 7/2002 | Hengstenberg | 42/79 |
| 6,557,290 B2 | * | 5/2003 | Kumler | 42/79 |
| 6,609,324 B1 | * | 8/2003 | Truitt, Jr. | 42/79 |

* cited by examiner

*Primary Examiner*—M. Clement
(74) *Attorney, Agent, or Firm*—Sonnenschein Nath & Rosenthal LLP

(57) ABSTRACT

A tube and ring assembly is provided for use with a shotgun barrel including a cylindrical tube, which may be a conventional choke tube or a carrier platform, with a first externally threaded portion at one end for threadingly engaging an internal thread in the shotgun barrel. A second externally threaded portion is provided on the tube which will remain exposed beyond the muzzle end of the shotgun barrel when the tube is fully threaded into engagement with the shotgun barrel. An internally threaded ring is also provided which is sized to be threadingly carried on an outside of the tube and to engage the second externally threaded portion of the tube such that the ring can be threaded onto the tube until it abuttingly engages the muzzle end of the shotgun barrel.

30 Claims, 3 Drawing Sheets

SHOTGUN ATTACHMENT

BACKGROUND OF THE INVENTION

This invention relates to attachments for a shotgun, and in particular to an attachment for use with the muzzle end of a shotgun barrel.

It is known to provide choke tubes as attachments for a shotgun barrel. In fact, many shotgun barrels have an internal thread formed in the barrel at the muzzle end, and a shoulder stop, so that a permanent or removable choke tube(s) may be threaded onto the barrel, through the use of a fine thread, such that the choke tube is threaded into the barrel until a first end of the choke tube engages and seats against the shoulder as described in U.S. Pat. No. 6,052,935. The choke tube may have an interior configuration to modify a pattern of the shot that are released from the shotgun shell when it is fired. This interior configuration may include a narrowing or a widening of the internal diameter interior of the choke tube, and may also include abrupt steps or pins that protrude into the inner passage of the choke tube to engage the wad of the shotgun shell. For example, U.S. Pat. No. 2,092,649 shows such a choke tube. It is also known to provide a semiannular rib in conjunction with a nozzle to cause wad retardation by imparting a spin to the wad as it progresses down the nozzle. U.S. Pat. No. 3,045,379 also discloses these features. It is also known to provide conventional chokes on a shotgun muzzle, which offer a constriction or a constriction followed by an expansion to adjust the spray pattern. These restrictions can also slow down a wad traveling down the barrel but they apply radial forces to the shot pellets, thereby distorting the resulting pattern. U.S. Pat. Nos. 5,452,535 and 6,128,846 disclose the use of projecting pins or rings to engage the shot wad, and also the use of other attachments to the choke tube to further condition the shot pattern. U.S. Pat. No. 5,317,825 discloses an attachment to a choke tube to reduce recoil.

The sole means of attachment of these internal choke tubes is the meshing of the fine thread of the interior of the barrel and the exterior of the choke tube. This provides only a single point of attachment and this attachment is secured only by snugging the seating of choke tube against the shoulder on the inside of the barrel. U.S. Pat. No. 6,052,935 attempts to overcome the problem associated with the required fine threads, that is, the need to rotate the choke relative to the barrel through a large number of turns by using discontinuous threads. However, this requires precise machining of both the internal portion of the shotgun barrel, i.e., the "bore" and the choke tube, and also requires precise rotational alignment between the two parts upon assembly.

This single point of attachment, in a cantilevered fashion, is subject to loosening due to vibrations occurring during the firing of the shotgun, from recoil, internal pressure and also the passage of the shot charge, wad and propelling gasses, if the choke tube is not continuously checked for tightness, a hazardous condition resulting from a loose tube could result. The tube can loosen from its proper position in the bore, by way of the backing-out of its threads or else by lateral vibration and movement. The resulting hazards may include the failure of the choke-tube-to-bore gas seal, the deformation of the dimensions of choke tube, the threads and the bore of the barrel, which can occur with catastrophic result. The instability of such cantilevered seating of the tube also negatively affects the pellet patterning efficiency and consistency of the shotgun choke tube even when properly seated.

U.S. Pat. No. 5,317,825 discloses an attachment for the exterior of a choke tube, however this attachment is to reduce recoil and it is not described in this patent to use the attachment to stabilize or prevent the loosening of the choke tube relative to the barrel.

It would therefore be an improvement in the art if there were provided a means for securing the attachment of the choke tube, or other attachment for a shotgun barrel that would minimize or prevent the unwanted loosening and lateral instability of the choke tube or attachment.

Further, since the choke tube or other attachment for the shotgun barrel must be made by utilizing the fine threads on the interior of the shotgun barrel, the attachment process is time consuming because the attachment requires many revolutions of the choke tube or attachment until the end of the choke tube or attachment seats against the shoulder. In some instances, particularly in law enforcement and military use, shotguns are used for different applications that require installing different attachments to the muzzle end of the barrel of the shotgun, where the weight-bearing strength and the overall stability of the tube within the bore and time for changing between different attachments may be at a premium.

It would therefore be an improvement in the art if there were provided a means for attaching various attachments, in a stable and secure manner to a shotgun barrel, and to be able to do so in a less time consuming manner than utilizing the fine threaded attachment arrangement provided on the interior of the shotgun barrel.

SUMMARY OF THE INVENTION

It is an object of the present invention to provide a means for securing the attachment of the choke tube, or other attachment for a shotgun barrel, that would prevent the unwanted loosening of the choke tube or attachment.

It is also an object of the present invention to provide a means for attaching various attachments, in a secure manner, to a shotgun barrel, in a less time consuming manner than utilizing the fine threaded attachment arrangement provided on the interior of the shotgun barrel.

These objects are inventively achieved in one embodiment where a locking arrangement for a shotgun choke is provided, wherein the shotgun choke comprises a cylindrical tube having a first external threaded portion at one end for threadingly engaging an internal thread in a shotgun barrel which is spaced inwardly of a muzzle end of the shotgun barrel and which firmly seats that first portion of the tube to the bore and seals it. Also, a lateral notch, slot or other device may be located at the opposite or forward end of the exposed tube beyond the muzzle end of the shotgun barrel, so as to permit the tube's internal seal and threads to be initially firmly seated and tightened. The stabilizing locking arrangement comprises a second external threaded portion on the choke cylindrical tube, which second portion will remain exposed beyond the muzzle end of the shotgun barrel when the choke is fully threaded into engagement with the bore of the said shotgun barrel. An internally threaded ring is provided which is sized to be threadingly carried on an outside of the choke and to engage the second external threaded portion of the choke such that the ring can be threaded onto the choke tube until it tightly and abuttingly securely engages the muzzle end of the shotgun barrel, providing an additional seating point adding to the longitudinal, lateral and axial security, seat and stability of the choke tube.

The objects are inventively achieved in a further embodiment where a tube and ring assembly for use with a shotgun barrel is provided comprising a cylindrical tube with a first externally threaded portion at one end for threadingly engaging an internal thread in the shotgun barrel which is spaced inwardly of a muzzle end of the shotgun barrel, and a second externally threaded portion which will remain exposed beyond said muzzle end of said shotgun barrel when said tube is fully threaded into engagement with said shotgun barrel. An internally threaded ring is also provided which is sized to be threadingly carried on an outside of the tube and to engage the second externally threaded portion of the tube such that the ring can be threaded onto the tube.

Other embodiments provide additional features of the invention as described in greater detail below.

DETAILED DESCRIPTION OF THE PREFERRED EMBODIMENT

Figure 1:
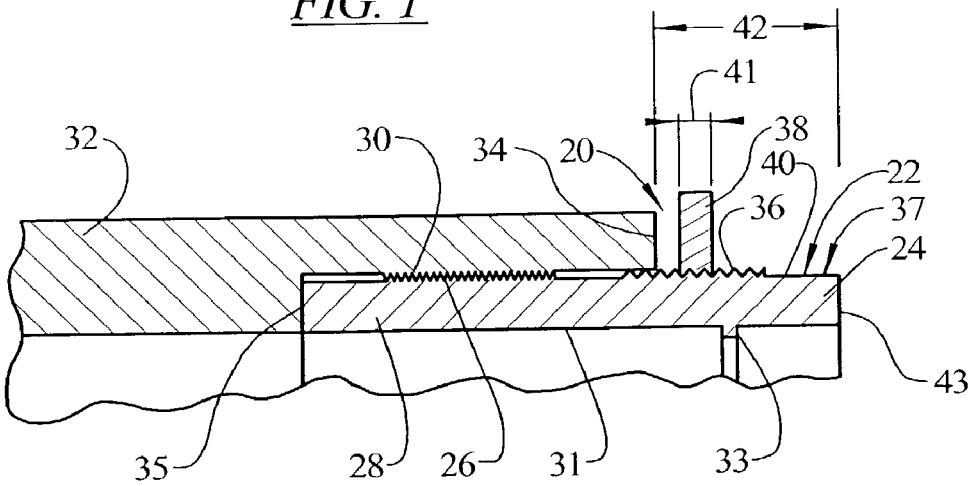
FIG. 1 is a longitudinal sectional view of an end portion of a shotgun barrel in which the present invention can be utilized and including a longitudinal sectional view of an embodiment of the invention as it is being assembled onto the shotgun barrel.

FIG. 1 shows, in a partial, longitudinal sectional view, a locking and stabilizing arrangement 20 for a shotgun choke 22, wherein the shotgun choke comprises a cylindrical tube 24 having a first external threaded portion 26 at or near a first end 28 for threadingly engaging an internal thread 30 in a shotgun barrel 32 which is spaced inwardly of a muzzle end 34 of the shotgun barrel. The choke 22 may also include a surface feature 33 on an interior surface 31 thereof in the form of projecting pins, a step, a gradual decrease in diameter, or other known construction to impede wad movement or condition the shot pattern achieved by the choke 22. For example, without limitation, the choke may be similar to those described in U.S. Pat. Nos. 5,452,535 and 6,128,846, the disclosures of which are incorporated herein by reference. As is well known, the shotgun barrel 32 has an internal seat or shoulder 35 adjacent to the internal thread 30 against which the first end 28 of the choke 22 will abut and seal when the choke is fully engaged with the barrel. A surface feature 37 may be applied to the choke 22 to assist in rotating the choke relative to the barrel 32. For example, a slot may be provided to be engaged by a tool. A roughened or non-circular outer circumferential surface may also be provided to enhance manual or tool assisted tightening of the choke 22 on the barrel 32.

Figure 2:
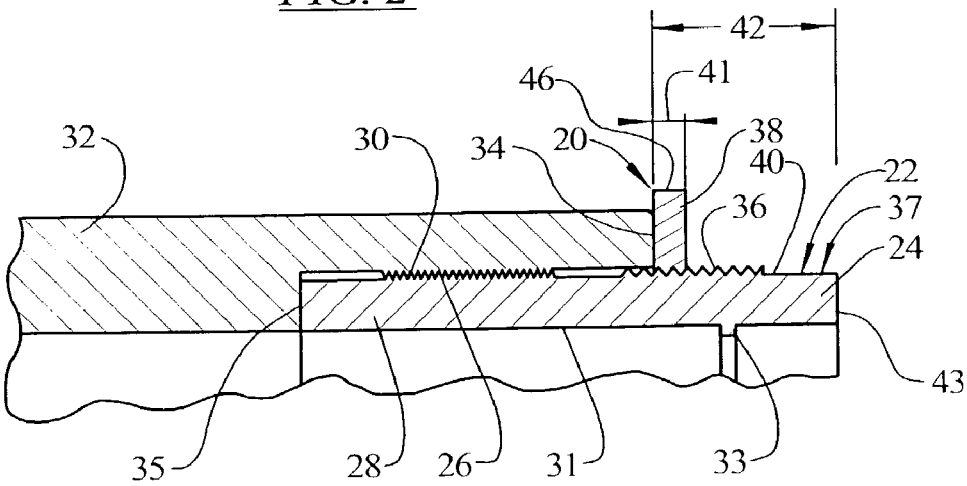
FIG. 2 is a longitudinal sectional view of an end portion of a shotgun barrel in which the present invention can be utilized and including a longitudinal sectional view of an embodiment of the invention as it is locked onto the shotgun barrel.

The locking and stabilizing arrangement 20 comprises a second external threaded portion 36 on the choke cylindrical tube 24. The second portion 36 remains exposed beyond the muzzle end 34 of the shotgun barrel 32 when the choke 22 is fully threaded into engagement with the shotgun barrel and may or may not extend a short distance into the barrel. An internally threaded ring 38 is provided which is sized to be threadingly carried on an outside 40 of the choke 22 and to engage the second external threaded portion 36 of the choke 22, such that the ring 38 can be threaded onto the choke until the ring abuttingly engages the muzzle end 34 of the shotgun barrel 32 as shown in FIG. 2. When the ring 38 is snugged up against the muzzle end 34 of the shotgun barrel 32, a second point of attachment, securement and stabilization of the choke 22 to the barrel 32 is achieved. This helps to stabilize the choke 28, to make it less susceptible to vibration and loosening relative to the barrel 32, and the ring 38 acts as a jam nut to prevent the inadvertent loosening of the choke from the barrel.

The ring 38 itself can have a variety of constructions and may simply be an internally threaded ring as shown in FIG. 1, or it may be of a "lock nut-type" of construction as is known, with internal features to hold the ring in place on the threads 36. For example, such a ring 38 may be good for only a one-time use and then discarded and replaced, or may be of the multiple use type. Also, the ring 38 may be a "double ring" type of construction, with one of the rings being a lock ring, such as a split ring, as is known. Further, the ring may be provided with other locking or retarding devices or arrangements, such as one or more set screws drilled and tapped into the ring radially. Once the ring is rotated into position, the set screw(s) can be tightened against the exterior surface of the choke 22 so that the ring 38 will not be able to back off from its engagement with the muzzle 34.

Thus, the ring 38 prevents the forward-rear, lateral and longitudinal vibration and movement of the choke 22, which is no longer only attached in a cantilevered fashion. This additional locking and stabilizing ring, over time, protects the gun barrel 32 and its threads 30, and the choke 22, from wear, mutilation and possible failure which could be caused by motion of the choke relative to the barrel (work hardening) and keeps the choke more securely and firmly aligned in its proper "directly straight ahead" position within the bore of the barrel. This will make the gun more accurate and the pattern distribution more even. Further, the use of the locking and stabilizing ring 38 protects the internal dimensions of the tube, the rear skirt seal 35, and any internal pattern conditioning wad-retarding devices 33 from being work-hardened out of round or being directly contacted by the shot charge metal and thereby marred, mutilated or worn-away. If a choke 22 were to tilt slightly in the barrel 32, it would allow and direct the shot metal to collide with an bear directly upon the internal protrusions, pins, etc. 33, which could cause them to be eroded. Further, tube tilt could cause the rear seating skirt to become off-center, and to thus protrude slightly into the bore itself, and the path of the approaching shot column. If a shotgun shell were to be fired after such a condition occurs, internal bore pressures could increase to a point which might cause the choke and barrel to separate or to cause the barrel to rupture, either of which would be costly and dangerous.

In an embodiment of the invention, as shown in FIGS. 1 and 2, the ring 38 may have an axial length 41 that is shorter than a protruding portion 42 of the choke 22 that carries the second threaded portion 36, such that when the ring is threaded onto the choke and into engagement with the muzzle end 34, a free end 43 of the choke will extend beyond the ring in a direction away from the muzzle. In an embodiment, the axial length 41 of the ring 38 is less than $1/4^{th}$ of an inch (6 mm), while in other embodiments, the axial length 41 is greater than $1/4^{th}$ of an inch (6 mm). For example, the axial length 41 may be longer than a length of the exposed threads 36 so that the ring will also function as a protection for the threads. An entire interior length of the ring 38 may be threaded, or only a portion of the length.

Figure 3:
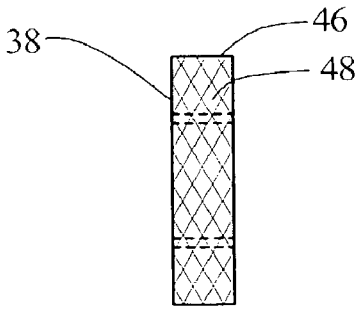
FIG. 3 is a side elevational view of the ring.
Figure 4:
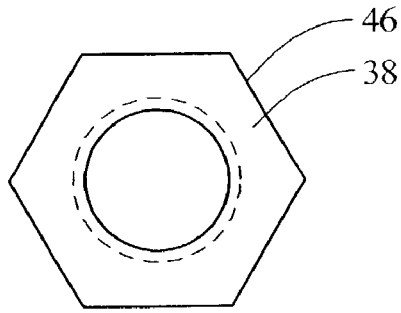
FIG. 4 is an end elevational view of the ring.

In an embodiment of the invention, the ring 38 has a round outer circumference 46. In some embodiments the ring 38 has an outer surface configuration 48 which enhances manual manipulation of the ring. For example, as shown in the embodiment of FIG. 3, the outer circumference 46 is knurled. In another embodiment, as shown in FIG. 4, the outer circumference 46 has a non-circular configuration, which preferably is a regular polygonal shape, such as a square or hexagonal shape.

Figure 5:
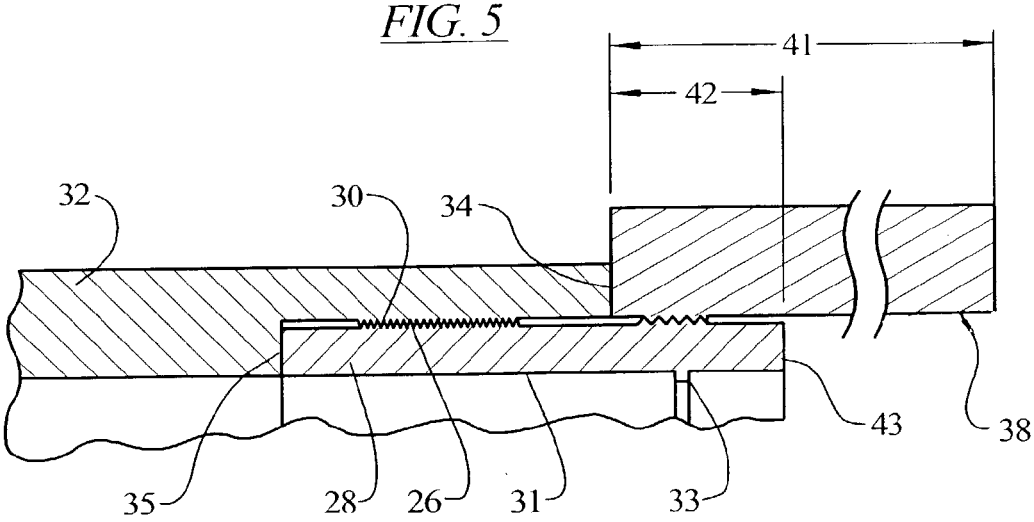
FIG. 5 is a longitudinal sectional view of an end portion of a shotgun barrel in which the present invention can be utilized and including a longitudinal sectional view of an embodiment of the invention with an elongated ring as it is locked onto the shotgun barrel.

In an embodiment of the invention, as shown in FIG. 5, the ring 38 has an axial length 41 greater than the protruding portion 42 of the choke 22, such that when the ring is threaded onto the choke and into engagement with the muzzle end 34, the ring will extend beyond the choke in a direction away from the muzzle.

Figure 6:
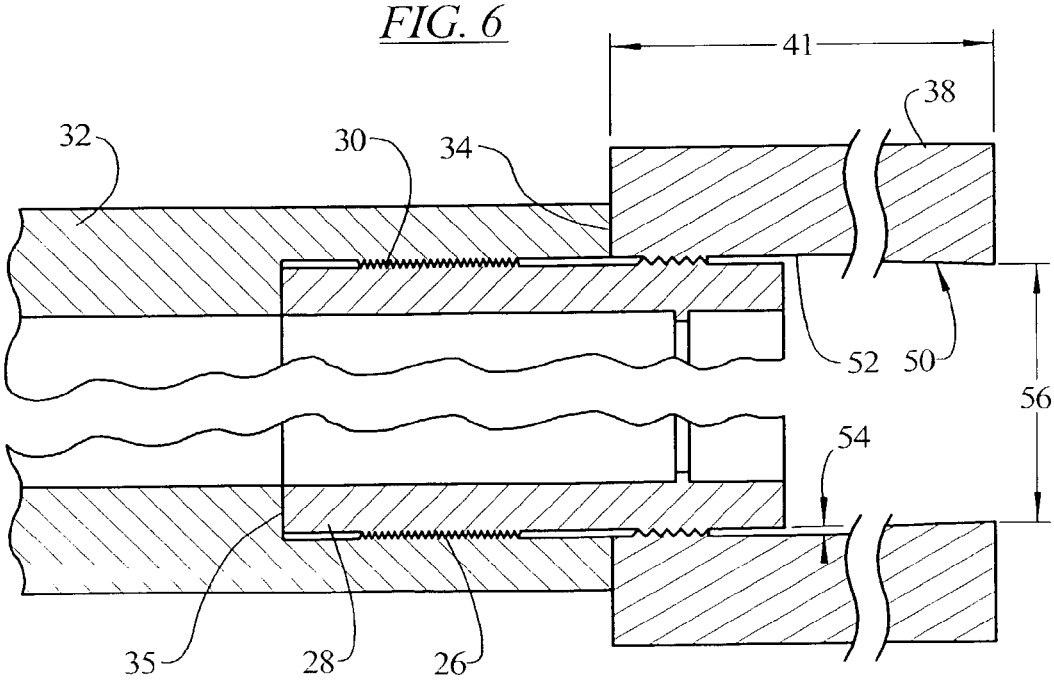
FIG. 6 is a longitudinal sectional view of an end portion of a shotgun barrel in which the present invention can be utilized and including a longitudinal sectional view of an embodiment of the invention with an elongated and constricting ring as it is locked onto the shotgun barrel.
Figure 7:
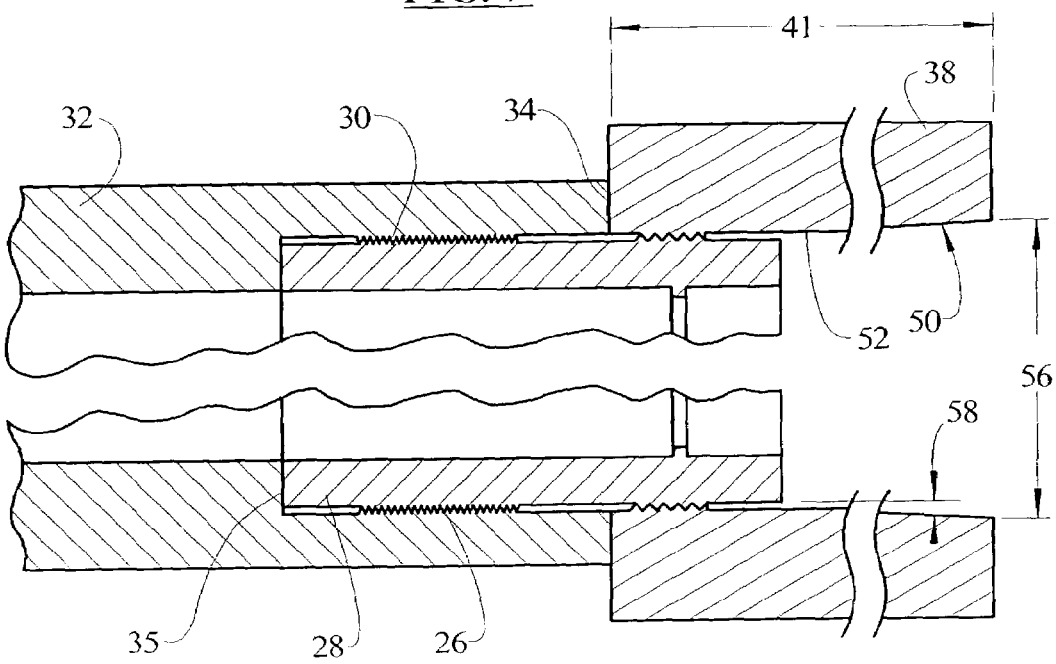
FIG. 7 is a longitudinal sectional view of an end portion of a shotgun barrel in which the present invention can be utilized and including a longitudinal sectional view of an embodiment of the invention with an elongated and expanding ring as it is locked onto the shotgun barrel.

In an embodiment of the invention, as shown in FIG. 6, the ring 38 incorporates a pattern-conditioning element 50 on an interior portion 52 thereof. As shown in FIG. 6, the pattern-conditioning element 50 comprises a constriction 54 of an interior diameter 56 of the ring 38 along its axial length 41. As shown in FIG. 7, the pattern-conditioning element 50 comprises an expansion 58 of the interior diameter 56 of the ring 38 along its axial length 41.

As shown in FIGS. 1 and 2, the second external threaded portion 36 has a thread pitch courser than the fine thread pitch of the first external threaded portion 26. This means that the ring 38 will move axially a greater distance for each revolution of the ring on the choke 22 than the axial distance the choke will move for each revolution of the choke relative to the shotgun barrel 32. Thus, a given axial length of the ring 38 can be captured on the second threaded portion 36 with fewer rotations of the ring relative to the choke 22 than are required to capture the same axial length of the choke on the shotgun barrel at the first threaded portion 26. This allows the ring 38 to be quickly assembled onto the choke 22 and to be moved into a snug engagement with the muzzle end 34 of the shotgun barrel 32. For example, it may take 20 full rotations of the choke 22 (taking up to a minute) to fully seat in the shotgun barrel, but only two full rotations of the ring 38 (taking only a few seconds to be snugged up against the muzzle 34.

In a further embodiment of the invention, the second external threaded portion 36 has a thread of opposite hand compared to the first external threaded portion 26. Thus, as either the ring 38 or the choke 22 is vibrated to rotate in one rotational direction, the other will be further tightened by such rotation and hence will prevent the loosening of the choke tube.

Figure 8:
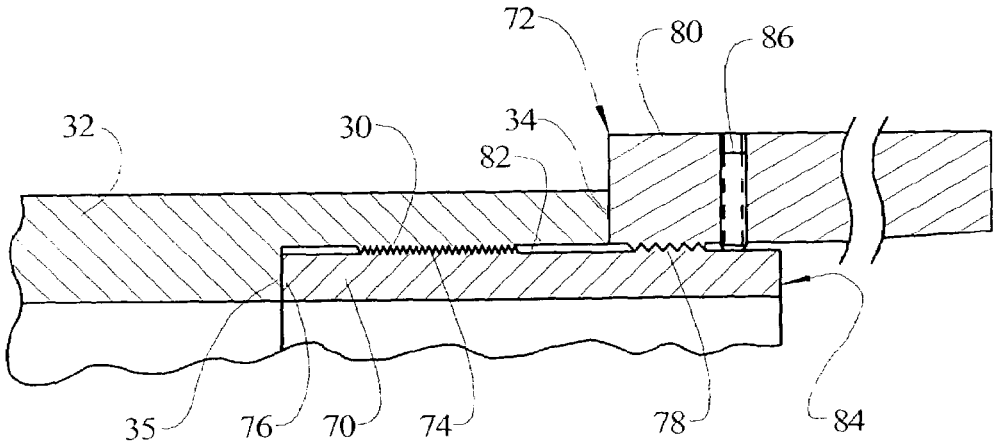
FIG. 8 is a longitudinal sectional view of an end portion of a shotgun barrel in which the present invention can be utilized and including a longitudinal sectional view of another embodiment of the invention as it is locked onto the shotgun barrel.

In a further embodiment of the invention, as illustrated in FIG. 8, the locking arrangement may be used in combination with a cylindrical tube 70 other than a choke tube. That is, the tube 70 may not have any pattern conditioning elements or features, and may merely be a continuation of the inner diameter of the shotgun barrel. In this embodiment, the invention comprises a tube and ring assembly 72 for use with the shotgun barrel 32 comprising the cylindrical tube 70 with a first externally threaded portion 74 at a first end 76 for threadingly engaging the internal thread 30 in the shotgun barrel which is spaced inwardly of the muzzle end 34 of the shotgun barrel. A second externally threaded portion 78 is provided which remains exposed beyond the muzzle end 34 of the shotgun barrel 32 when the tube 70 is fully threaded into engagement with the shotgun barrel. An internally threaded ring 80 is provided which is sized to be threadingly carried on an outside 82 of the tube 70 and to engage the second externally threaded portion 78 of the tube such that the ring can be threaded onto the tube until the ring abuttingly engages the muzzle end 34 of the shotgun barrel 32.

The ring 80 may have all of the aspects of the ring 38 described above, that is, it may have an axial length lesser or greater than an exposed axial length of the tube 70, it may have an outer surface configuration that enhances manual manipulation or rotation of the ring, and it may incorporate a pattern conditioning element or some other feature.

In this embodiment, the tube 70 may be used to protect the internal threads of the shotgun barrel, if no pattern conditioning is desired, or the tube may function as a carrier platform for the ring, wherein the ring has functional elements desirable for use with the shotgun.

A surface feature 84 may be applied to the tube 70 to assist in rotating the tube relative to the barrel 32. For example, a slot may be provided to be engaged by a tool. A roughened or non-circular outer circumferential surface may also be provided to enhance manual or tool assisted tightening of the tube 70 on the barrel.

Thus, the present invention provides a novel method of locking a tube 28, 70 to a shotgun barrel 32 comprising the steps of inserting the tube into the shotgun barrel, rotating the tube relative to the shotgun barrel to engage a threaded connection 26, 30, 74 between the tube and the shotgun barrel, continuing the relative rotation between the tube and the shotgun barrel until the tube abuttingly engages and seals with an internal step 35 in the shotgun barrel, positioning a ring 38, 80 around an exterior 40, 82 of the tube, rotating the ring relative to the tube to engage a threaded connection 36, 78 between the tube and the ring, and continuing the relative rotation between the tube and the ring until the ring abuttingly engages a muzzle end 34 of the shotgun barrel.

It is to be understood that any of the ring configurations or features can be used with any of the tubes shown in the various figures in various combinations.

Although the present invention has been described with reference to a specific embodiment, those of skill in the art will recognize that changes may be made thereto without departing from the scope and spirit of the invention as set forth in the appended claims.

As is apparent from the foregoing specification, the invention is susceptible of being embodied with various alterations and modifications which may differ particularly from those that have been described in the preceding specification and description. It should be understood that I wish to embody within the scope of the patent warranted hereon all such modifications as reasonably and properly come within the scope of my contribution to the art.

What is claimed is:

1. A locking arrangement for a shotgun choke, wherein said shotgun choke comprises a cylindrical tube having an interior passage sized for passage of projectiles fired by a shotgun and a first external threaded portion at one end for threadingly engaging an internal thread in a shotgun barrel which is spaced inwardly of a muzzle end of the shotgun barrel, said locking arrangement comprising a second external threaded portion on said choke cylindrical tube, which second portion will remain exposed beyond said muzzle end of said shotgun barrel when said choke is fully threaded into engagement with said shotgun barrel, and an internally threaded ring sized to be threadingly carried on an outside of said choke and to engage said second external threaded portion of said choke, such that said ring can be threaded onto said choke until it abuttingly engages said muzzle end of said shotgun barrel.

2. The locking arrangement according to claim 1, wherein said ring has an axial length of less than $1/4^{th}$ of an inch (6 mm).

3. The locking arrangement according to claim 1, wherein said ring has a round outer circumference.

4. The locking arrangement according to claim 1, wherein said ring has an outer surface configuration which enhances manual manipulation of said ring.

5. The locking arrangement according to claim 4, wherein said outer surface is knurled.

6. The lacking arrangement according to claim 4, wherein said outer surface has a non-circular configuration.

7. The locking arrangement according to claim 1, wherein said ring has an axial length less than a remaining exposed portion of said choke, such that when said ring is threaded onto said choke and into engagement with said muzzle, a free end of said choke will extend beyond said ring in a direction away from said muzzle.

8. The locking arrangement according to claim 1, wherein said ring has an axial length greater than a remaining exposed portion of said choke, such that when said ring is threaded onto said choke and into engagement with said muzzle, said ring will extend beyond said choke in a direction away from said muzzle.

9. The locking arrangement according to claim 8, wherein said ring incorporates a pattern conditioning element on an interior portion thereof.

10. The locking arrangement according to claim 9, wherein said pattern conditioning element comprises a constriction of an interior diameter of said ring along its axial length.

11. The locking arrangement according to claim 9, wherein said pattern conditioning element comprises an expansion of an interior diameter of said ring along its axial length.

12. The locking arrangement according to claim 1, wherein said second external threaded portion has a coarser thread pitch than a thread pitch of said first external threaded portion.

13. The locking arrangement according to claim 1, wherein said second external threaded portion has a thread of opposite hand compared to the first external threaded portion.

14. A tube and ring assembly for use with a shotgun barrel comprising a cylindrical tube with a first externally threaded portion at one end for threadingly engaging an internal thread in said shotgun barrel which is spaced inwardly of a muzzle end of said shotgun barrel, and a second externally threaded portion which will remain exposed beyond said muzzle end of said shotgun barrel when said tube is fully threaded into engagement with said shotgun barrel, said second threaded portion having a differing thread configuration from said first external tbreaded portion, and an internally threaded ring sized to be threadingly carried on an outside of said tube and to engage said second externally treaded portion of said tube such that said ring can be threaded onto said tube until it abuttingly engages said muzzle end of said shotgun barrel.

15. The tube and ring assembly according to claim 14, wherein said tube includes a shot pattern conditioning element on an interior surface thereof.

16. The tube and ring assembly according to claim 14, wherein said ring has an axial length of less than $1/4^{th}$ of an inch (6 mm).

17. The tube and ring assembly according to claim 14, wherein said ring has a round outer circumference.

18. The tube and ring assembly according to claim 14, wherein said ring has an outer surface configuration which enhances manual manipulation of said ring.

19. The tube and ring assembly according to claim 18, wherein said outer surface is knurled.

20. The tube and ring assembly according to claim 18, wherein said outer surface has a non-circular configuration.

21. The tube and ring assembly according to claim 14, wherein said ring has an axial length less than a remaining exposed portion of said tube, such that when said ring is threaded onto said tube and into engagement with said muzzle, a free end of said tube will extend beyond said ring in a direction away from said muzzle.

22. The tube and ring assembly according to claim 14, wherein said ring has an axial length greater than a remaining exposed portion of said tube, such that when said ring is treaded onto said tube and into engagement with said muzzle, said ring will extend beyond said tube in a direction away from said muzzle.

23. The tube and ring assembly according to claim 22, wherein said ring incorporates a pattern conditioning element on an interior portion thereof.

24. The tube and ring assembly according to claim 23, wherein said pattern conditioning element comprises a constriction of an interior diameter of said ring along its axial length.

25. The tube and ring assembly according to claim 23, wherein said pattern conditioning element comprises an expansion of an interior diameter of said ring along its axial length.

26. The tube and ring assembly according to claim 14, wherein said second external threaded portion has a coarser thread pitch than a thread pitch of said first external treaded portion.

27. The tube and ring assembly according to claim 14, wherein said second external threaded portion has a thread of opposite hand compared to the first external threaded portion.

28. The tube and ring assembly according to claim 14, wherein said tube comprises a surface feature to assist in rotating the tube relative to the barrel.

29. A method of locking a tube to a shotgun barrel comprising:

inserting said tube into said shotgun barrel;

rotating said tube relative to said shotgun barrel to engage a first threaded connection between said tube and said shotgun barrel;

continuing said relative rotation between said tube and said shotgun barrel until said tube abuttingly engages an internal step in said shotgun barrel;

positioning a ring around an exterior of said tube;

rotating said ring relative to said tube to engage a second threaded connection between said tube and said ring, said second threaded connection having a differing thread configuration from said first threaded connection, continuing said relative rotation between said tube and said ring until said ring abuttingly engages a muzzle end of said shotgun barrel.

30. A tube and ring assembly for use with a shotgun barrel comprising a cylindrical tube having an interior passage sized for passage of projectiles fired by a shotgun and a first externally threaded portion at one end for threadingly engaging an internal thread in said shotgun barrel which is spaced inwardly of a muzzle end of said shotgun barrel, and a second externally threaded portion which will remain exposed beyond said muzzle end of said shotgun barrel when said tube is fully threaded into engagement with said shotgun barrel, and an internally threaded ring sized to be threadingly carried on an outside of said tube and to engage said second externally threaded portion of said tube such that said ring can be threaded onto said tube until it abuttingly engages said muzzle end of said shotgun barrel.

* * * * *